United States Patent [19]

Barlow

[11] 3,948,520

[45] Apr. 6, 1976

[54] COMPETITIVE ROUND-ABOUT RACING GAME

[75] Inventor: Gordon A. Barlow, Skokie, Ill.

[73] Assignee: Marvin Glass & Associates, Chicago, Ill.

[22] Filed: Aug. 1, 1974

[21] Appl. No.: 493,512

[52] U.S. Cl. ..... 273/86 F; 46/243 P

[51] Int. Cl.[2] ..... A63F 9/14

[58] Field of Search ..... 273/86 R, 86 B, 86 F; 46/202, 206, 243 P; 272/31 R

[56] References Cited

UNITED STATES PATENTS

| | | | |
|---|---|---|---|
| 2,387,859 | 10/1945 | Schmidt | 273/86 R |
| 2,687,304 | 8/1954 | Northrop et al. | 273/86 B |
| 3,205,833 | 9/1965 | Fitzpatrick | 273/86 B X |
| 3,473,805 | 10/1969 | Biller | 273/86 F |
| 3,588,111 | 6/1971 | Agarwala | 273/86 B X |

FOREIGN PATENTS OR APPLICATIONS

| | | | |
|---|---|---|---|
| 1,221,558 | 2/1971 | United Kingdom | 46/206 |

*Primary Examiner*—Anton O. Oechsle
*Attorney, Agent, or Firm*—Coffee & Sweeney

[57] ABSTRACT

A competitive round-about game apparatus including a plurality of playing pieces representing members of a Roller Derby team, or the like, wherein the playing pieces move along a plurality of motor driven track-forming channels. The game generally includes a housing having an oval-shaped inclined racing platform with the channels formed therein and defining the paths of travel of the playing pieces along the channels and a drive mechanism for independently moving the playing pieces in opposing channels along the channels relative to the platform. The playing pieces include flanges or wings protruding from the sides thereof with which opposing playing pieces in opposite channels can be caused to contact one another in an attempt to dislodge the playing pieces from the track, forming channels, and thereby score points or alternatively prevent the scoring of points, as in a Roller Derby game. The track-forming channels are variably spaced relative to each other at various points along the oval platform to permit opposing playing pieces to pass one another at selected points along the track.

10 Claims, 9 Drawing Figures

10
12
14
20
22
24
5
82
86
84
88
A
5
17
C
46
48
72
64
4
4
A
116
104
110
56
62
40
3
3
B
90
112
92
94
17
16
15
A
A
B
82
86
84
88

17
18
15
24
42
14
92
22
52
42
20
112
52
44
16
116
104
94
48
52
42
46
102
118
110
90
114
108
98
60

17
18
15
48
24
42
52
50
22
50
56
72
64
16
20
50
42
52
62
74
46
42
52
44
58
68
60
40
70

28
17
86
18
88
15
14
24
52
89
84
89
32
38
22
52
30
44
82
76
82
16
42
42
50
46
50
36
50
42
52
50
78
80
83
80
48
60

COMPETITIVE ROUND-ABOUT RACING GAME

BACKGROUND AND SUMMARY OF THE INVENTION

This invention relates to competitive game devices and more particularly to round-about toy racing games wherein the object is to accumulate points by knocking down or passing an opposing player's playing pieces on a platform or playing surface defining a racing track.

Round-about type toys have enjoyed a great deal of popularity throughout the years. These toys usually consist of a figure traveling along a given continuous path on a platform. The object of many of these games is to hit a moving target or hit a stationary target while moving in relation thereto, sometimes involving the element of spaced. Rarely is there any simultaneous competition between opposing players having opposing playing pieces traveling slong opposing paths.

It is an object of this invention to provide a new, amusing and competitive round-about toy which simulates the competition involved in the racing game known as Roller Derby.

More particularly, it is an object of this invention to provide a toy of the character described in which the movement of the playing pieces is effected by a continuous motor driven track which moves about an oval or circular inclined platform, and causes the playing pieces driven thereby to travel in an irregularly shaped or undulating path along the platform simulating the oval track of the Roller Derby game.

These and other objects are accomplished in one form of the invention currently contemplated by providing a housing having a oval-shaped platform, a plurality of continuous channels formed in the platform defining the path of travel of a plurality of playing pieces that are movably received at their bases in the channels, and drive means for moving the playing pieces along the channels relative to the platform.

In the preferred embodiment, a continuous spring-like helical coiled moving element is disposed for longitudinal movement in each irregularly shaped channel in the platform. Three channels are provided. The drive means is comprised of two selectively variable speed motors, one of which moves the helical moving element in the central track-forming channel relative to the platform, and a second motor which moves the helical moving element in the inner and outer irregularly shaped chanels channels the platform.

A plurality of playing pieces representing one team are removably mounted on the central track and a plurality of playing pieces representing the opposing team are removably mounted on the inner and outer two tracks. All of the playing pieces are provided with a pair of flanges or wings protruding from the sides thereof such that at various points along their travel of the channels, contact can occur between playing pieces for blocking or knocking down opponent players.

Other objects, features and advantages will become apparent when viewed in connection with the accompanying drawings and the specification therewith.

DESCRIPTION OF THE PREFERRED EMBODIMENT

Figure 1:
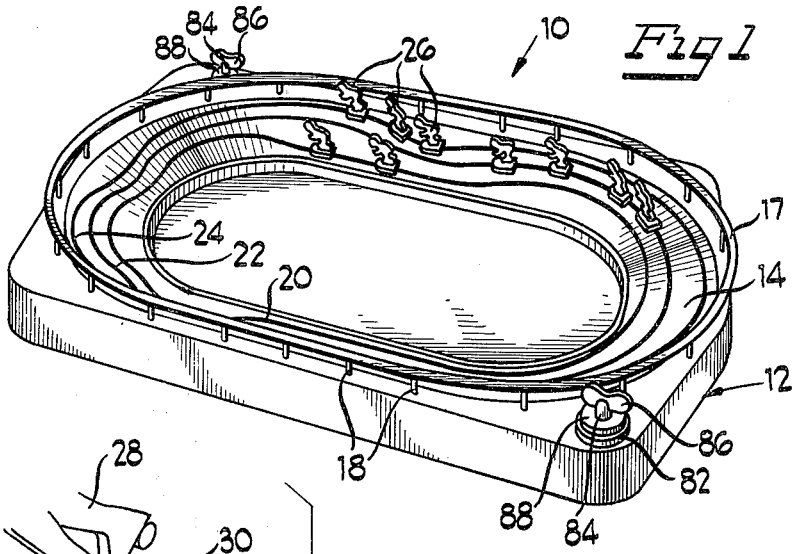
FIG. 1 is a perspective view of the round-about game apparatus of this invention.
Figure 7:
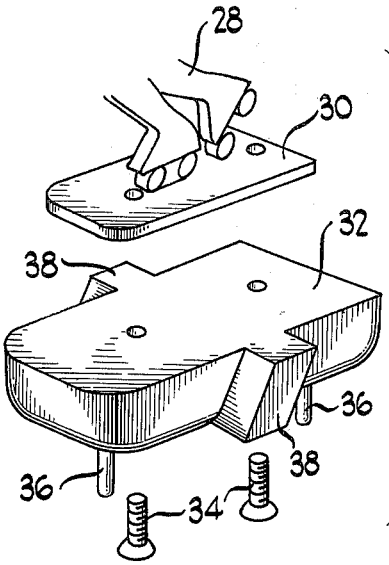
FIG. 7 is an exploded perspective view, on an enlarged scale, of the base components of one of the playing pieces.

The competitive round-about game apparatus, generally designated 10, includes a frame or housing, generally designated 12, defining an inclined oval platform 14 which is on top of the frame, sloping downward from an outermost edge 15 to an innermost edge 16. A guard rail 17 is supported on a plurality of posts 18, around the outer circumference of the platform 14. Three channels 20, 22 and 24 are provided in the form of slots in the platform 14.

A plurality of playing pieces, generally designated 26, are removably receivable in the channels 20, 22 and 24. More particularly, each playing piece 26 includes an upper portion 28, in the form of a simulated member of a Roller Derby team, which is mounted on a base plate 30. The base plate 30 is attached to a base block 32 by means of two screws 34. The base block 32 includes two pins 36 depending from the bottom thereof for engagement within the channels 20, 22 and 24. The base block 32 also includes two wings or flanges 38 protruding from the sides thereof and inclined upwardly and rearwardly from the bottom thereof.

Each channel or slot is provided with associated drive means, to move the playing pieces 26 around the track-forming channels. More particularly, the drive means 40 includes an enclosure 42 beneath each of the tracks 20, 22 and 24 formed between a lower plate 44 and the platform 14. The plate 44 is integrally molded with the frame 12 which includes inner and outer vertical platform support walls 46 and 48 and two upwardly protruding ribs 50 which generally follow the locus of the tracks 20, 22 and 24. The ribs 50 and plate 44 define the enclosures 42 beneath the slotted tracks 20, 22 and 24. A continuous helical moving element 52 beneath the central track 22 is caused to move longitudinally within the respective enclosure 42 by engagement with a gear 56 which is rotatably mounted on top of a bearing post 58 which is mounted on a bottom plate 60 on the interior of the frame 12. The gear 56 is integrally formed or interconnected with a smaller gear 62 which is in constant engagement with a larger gear 64, rotatably mounted on top of a bearing post 68 which also is mounted on the base plate 60 on the interior of the frame 12. An electric motor 70 drives the gear 64 by means of a pinion gear 72 mounted on a motor shaft 74.

Figure 9:
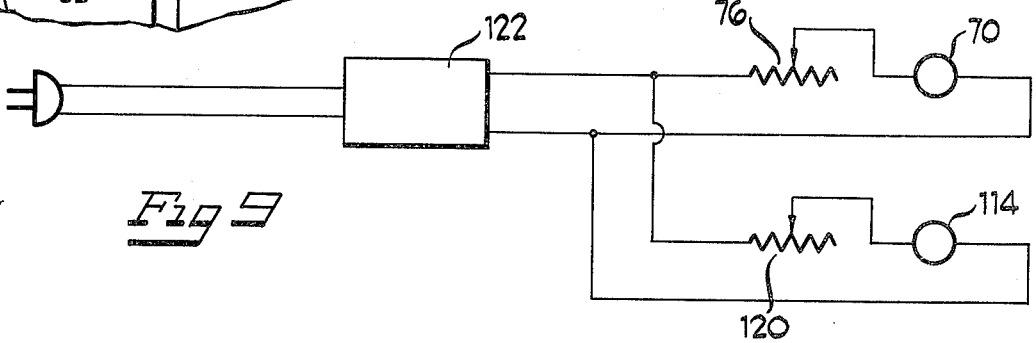
FIG. 9 is a somewhat schematic representation of the electrical circuitry and components of the game apparatus.
Figure 5:
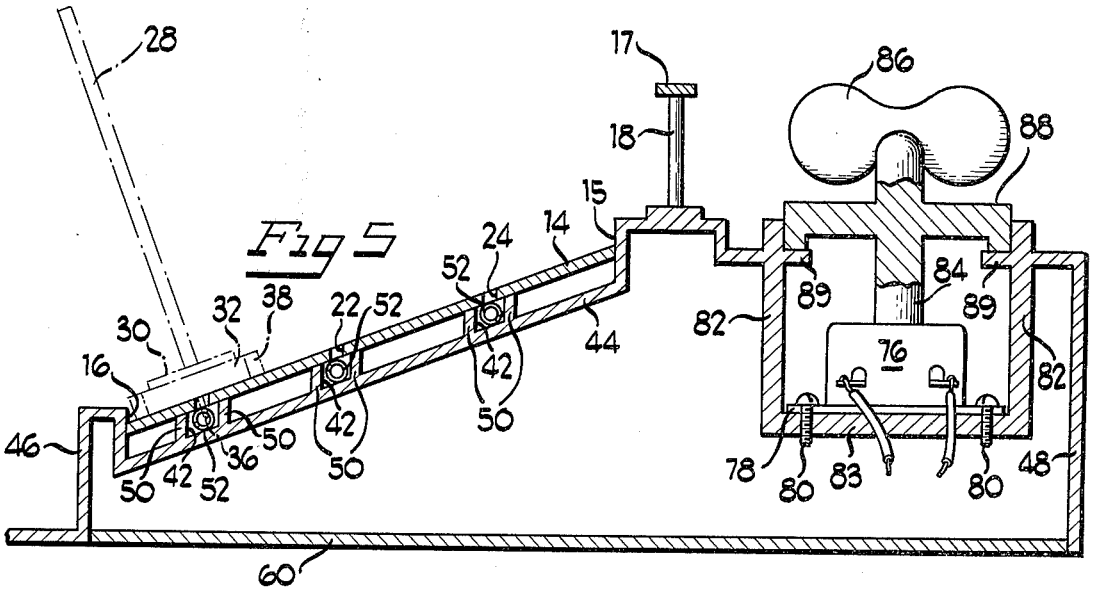
FIG. 5 is a fragmented vertical section, on an enlarged scale, taken generally along line 5—5 of FIG. 2.

The speed of the motor 70 is controlled by a rheostat 76 (FIGS. 5 and 9) which is mounted by means of flanges 78 and screws 80 within a circular recessed area of the frame 12 defined by interior walls 82 and 83 (FIG. 5). The rheostat 76 is adjusted by means of a central shaft 84 which protrudes upwardly of the frame and is provided with a key-type handle 86. A flanged portion 88 is in engagement with the frame about the top of the recessed area by abutment with flanges 89.

Figure 2:
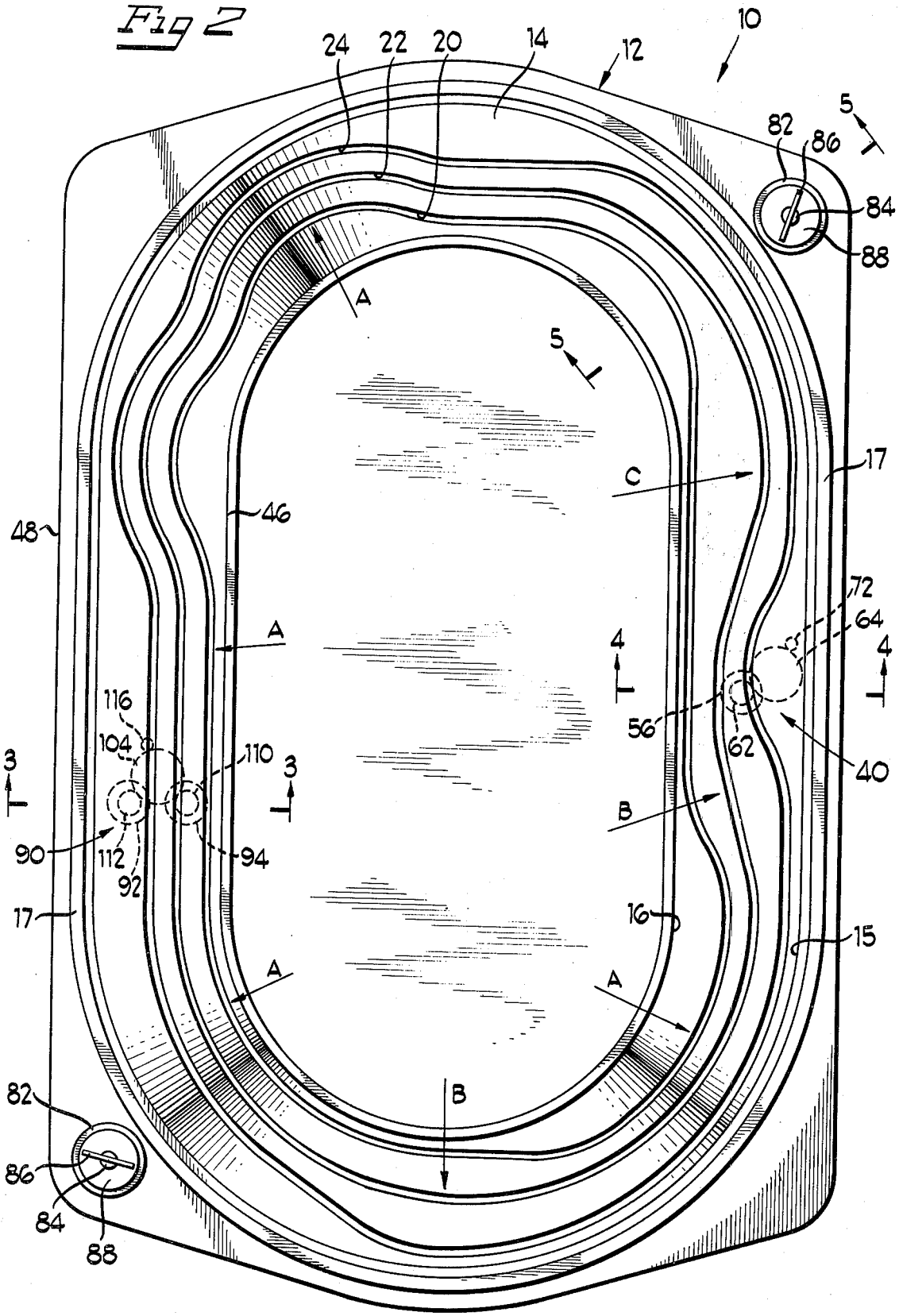
FIG. 2 is a top plan view, on an enlarged scale, of the game apparatus of FIG. 1.
Figure 3:
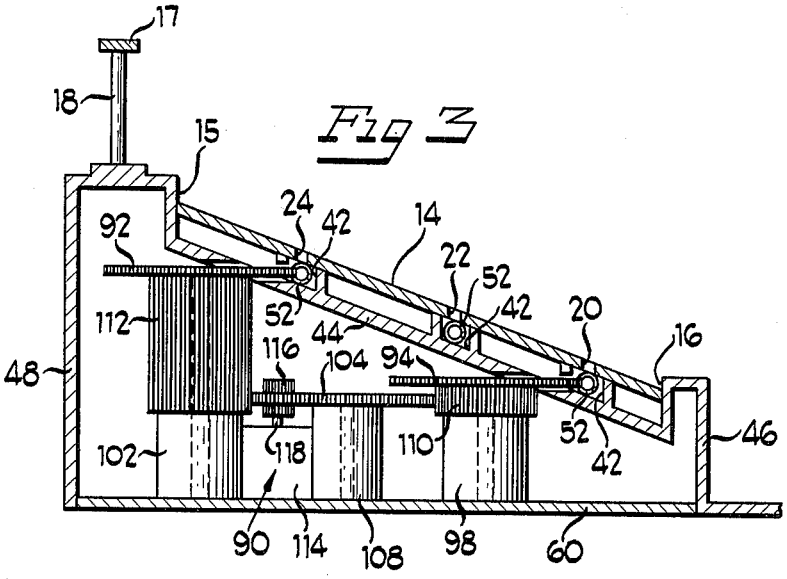
FIG. 3 is a fragmented vertical section, on an enlarged scale, taken generally along the line 3—3 of FIG. 2.
Figure 4:
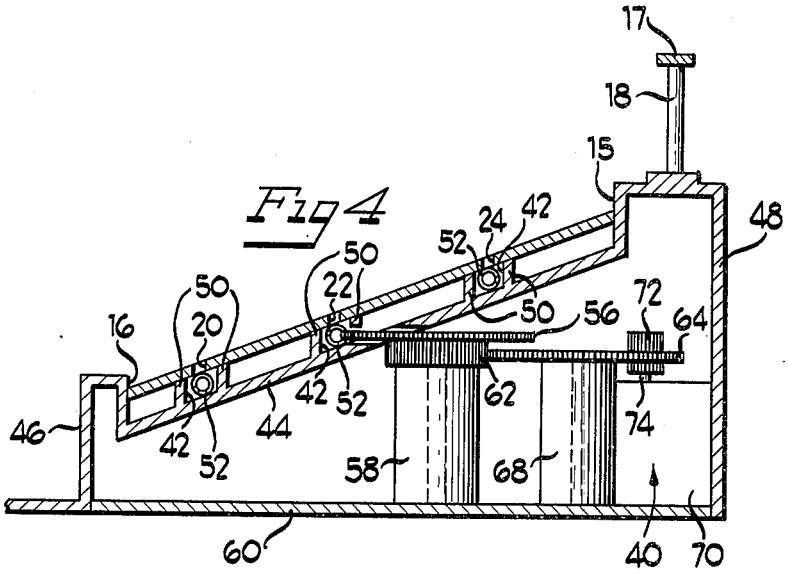
FIG. 4 is a fragmented vertical section, on an enlarged scale, taken generally along the line 4—4 of FIG. 2.

A second drive mechanism, generally designated 90 in FIGS. 2 and 3, is provided for longitudinally driving the continuous helical moving elements 52 beneath the tracks 20 and 24. More particularly, the second drive means 90 includes a gear 92 in engagement with the moving elements 52 beneath the track 24 and a second gear 94 in engagement with the coil element 52 beneath the track 20. The gear 94 is rotatably mounted on top of a bearing post 98 which is mounted on the base plate 60 on the interior of the frame 12. The gear 92 is rotatably mounted on top of bearing post 102 which is mounted on the base plate 60. A gear member 104 is mounted on top of a bearing post 108 which is mounted on the base plate 60. The gear 104 is in meshed engagement with a smaller gear member 110 formed integrally with the gear 94 and also in meshed engagement with a smaller diameter gear 112 which is formed integrally with the gear 92. A motor 114 drives the gear 104 through a small gear 116 mounted on top of a motor drive shaft 118. The similar gear ratios between gear 92 and 94 cause the continuous helical moving elements 52 within tracks 24 and 20 to travel at the same speed.

An additional rheostat 120 (FIG. 9) is provided for adjusting the speed of the motor 114. The rheostat is mounted and hand adjusted by similar means as described in relation to the rheostat 76 in FIG. 5, and like reference numerals have been applied in FIG. 2 to like parts. Within the electrical circuit, as can best be seen in FIG. 9, a transformer 122 is used to reduce the electrical power voltage from a standard wall outlet to a relatively safer level.

Figure 6:
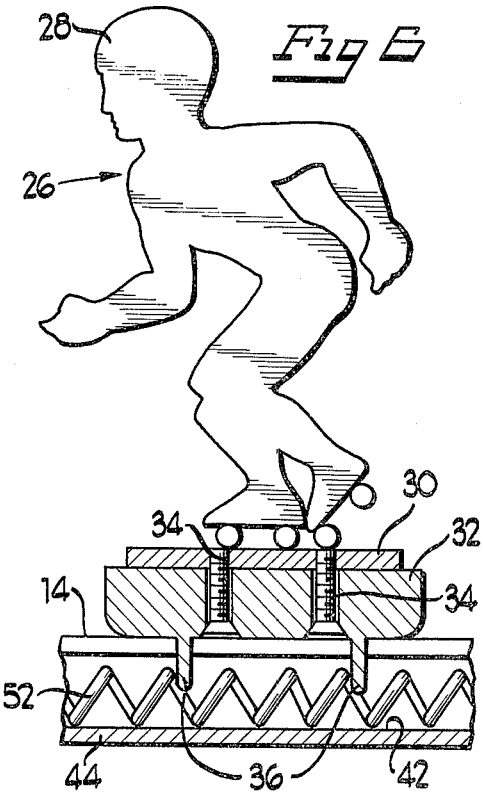
FIG. 6 is a vertical section, on an enlarged scale, of one of the playing pieces mounted on a track, with parts broken away.

The playing pieces 26 are placed on the platform 12 in the position as indicated by the phantom lines in FIG. 5. The pins 36 on the bottom of the base block 32 of each playing piece 26 engage between the coils of the continuous helical moving elements 52, as best seen in FIG. 6. As the electric motors 70 and 114 cause the helical moving elements to move around within their respective enclosures 42, the playing pieces 26 move therewith along their respective channels 20, 22, and 24. The playing pieces 26 are caused to move around the channels 20, 22 and 24 at similar or relatively different speeds depending upon the adjustments of the rheostats 76 and 120.

Figure 8:
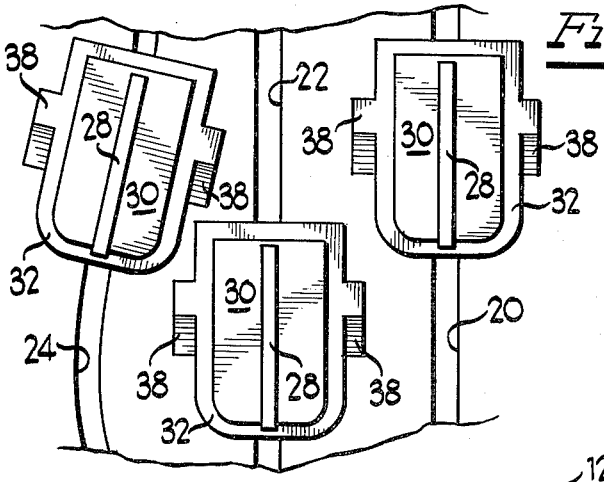
FIG. 8 is a top plan view of three of the playing pieces in the combination of track-forming channels.

All of the playing pieces can be designated by numbers or preferably, by color so as to indicate members of different teams. In the embodiment of the game shown herein, members of one team are positioned on the center channel 22 and the members of a second team are divided and placed on the inner and outer channels 20 and 24 respectively. The object of the game is to control the speed of the players traversing the channels by adjusting the individual rheostats as described above. The player controlling the playing pieces 26 on the center channel 22 attempts to have his playing pieces 26 pass the opponent's playing pieces on the other two channels, or vice versa, for which he accumulates points. The player which controls the playing pieces 26 on the inner and outer two channels will attempt to manipulate his playing pieces by controlling their speed so as to prevent the playing pieces on the center track from passing his playing pieces. Either player can attempt to knock down the playing pieces of an opposing player. Within certain areas on the platform, the distance between the tracks 22 and 24, and 22 and 20, varies such that a skillful player can speed up or slow down his playing pieces 26 to pass the opponent playing pieces. As best seen in FIGS. 2 and 8, at certain areas of the playing platform 14 the tracks are spaced such that contact between the flanges or wings 38 of the playing pieces can cause a playing piece to be lifted up and out of a track and thus caused to fall over. These areas are indicated generally by the arrows A in FIG. 2. If a player on the central track causes a playing piece on one of the outer tracks to fall over he can score a point. If a player with playing pieces on the inner and outer two tracks can prevent a player on the inner track from passing his playing pieces, he can prevent points from being scored against him. He also could knock over players on the central tracks. At the two areas designated by arrows B in FIG. 2, the track-forming channels 20, 22 and 24 all are sufficiently spaced to permit playing pieces on the central track 22 to pass playing pieces on either of the inner or outer tracks 20 and 24, respectively. At the area designated by arrow C in FIG. 2, the central and inner tracks 22 and 20, respectively, are sufficiently spaced to permit passing of their respective playing pieces, but no passing can take place between the inner and outer tracks 22 and 24, respectively. Of course, various combinations of areas A, B and C at various locations may be devised.

Furthermore, the apparatus as shown and described herein has gears 94 and 110 for the inner track 20 generally of the same respective diameters as the comparable gears 92 and 112 for the outer track 24, with all said gears driven by the common gear 104. With this gearing arrangement, and with the inner track 20 being of a lesser circumference than the outer track 24, the playing pieces for the inner track will be driven at a greater speed than the playing pieces for the outer track. The inner track playing pieces thus will travel about the platform 15 with increasing spacing longitudinally relative to outer track playing pieces and thereby create an increasing gap within which the independently operable playing pieces of the central track 22 may be manipulated. Of course, the gear ratios, the relative circumferences of the tracks, and the disposition of the lateral spacing areas A, B, and C all may be varied within the concepts of the present invention to provide varying game apparatus requiring different tactical approaches during the play of the game.

The foregoing detailed description has been given for clearness of understanding only and no unnecessary limitations should be understood therefrom as some modifications will be obvious to those skilled in the art.

I claim:

1. A racing type game, comprising:

a base structure having platform means with means defining a plurality of side-by-side non-intersecting tracks, a plurality of playing pieces movable along said tracks, independent individually controlled and variable speed drive means for at least some of said tracks and operatively associated with the playing pieces of the respective tracks for moving the playing pieces therealong in the same direction at varying speeds for the different tracks, and said tracks being variably spaced relative to each other and the size of said playing pieces to permit playing pieces of different tracks to pass each other at at least one selected portion along the length of the tracks and to cause the playing pieces of the different tracks traveling in the same direction to interfere with one another along at least another portion of the track to cause at least one of the playing pieces to disengage from the drive means and fall off of the track, said playing pieces being removably mounted on said tracks and removably connected to said drive means so as to be capable of being knocked off the tracks only upon interference by a playing piece approaching from the rear on an adjacent track.

2. The game of claim 1 wherein said tracks are defined by slots in said platform and said playing pieces are removably mounted on the tracks by means of protrusions positioned in said slots.

3. The game of claim 2 including channel means beneath said slots, said individual drive means having playing piece engaging portions in said channel means.

4. The game of claim 3 wherein said playing piece engaging portions are defined by coiled members disposed in said channel means with said playing pieces being engageable therewith by positioning said protrusions between the coils of said coiled members.

5. The game of claim 4 wherein the game is a roundabout game with said tracks on said platform defining closed endless paths and wherein said coiled members are moved bodily longitudinally within said channel means.

6. The game of claim 1 wherein said playing pieces have wing-type interference protrusions on at least one side thereof, said interference protrusions having a forwardly facing abutment surface inclined rearwardly and upwardly to effect a wedging action when engaging a playing piece on an adjacent track.

7. A racing type game, comprising:

a base structure having a platform with means defining a plurality of side-by-side tracks, a plurality of playing pieces removably mounted on said tracks and movable therealong, independent individually controlled variable speed drive means for at least some of said tracks and operatively associated with the playing pieces of the respective tracks for moving the playing pieces at varying speeds for the different tracks, and said tracks being variably spaced relative to each other and the size of the playing pieces to permit playing pieces of different tracks to pass each other at at least one area along the track and to preclude the playing pieces of the different tracks from passing each other without interference thereof at at least another area along the track, the playing pieces having wing-type interference protrusions on at least one side thereof, said interference protrusions having a forwardly facing abutment surface and a rearwardly facing abutment surface, each surface being inclined rearwardly and upwardly to effect a wedging action when engaging an interference protrusion on a playing piece on an adjacent track.

8. A racing type game, comprising:

a base structure having platform means with means defining a plurality of side-by-side non-intersecting tracks, a plurality of playing pieces movable along said tracks, independent individually controlled and variable speed drive means for at least some of said tracks and operatively associated with the playing pieces of the respective tracks for moving the playing pieces therealong in the same direction at varying speeds for the different tracks, and said tracks being variably spaced relative to each other and the size of said playing pieces to permit playing pieces of different tracks to pass each other at at least one selected portion along the length of the tracks and to cause the playing pieces of the different tracks traveling in the same direction to interfere with one another along at least another portion of the track to cause at least one of the playing pieces to disengage from the drive means and fall off of the track, said game including three side-by-side tracks, the outermost tracks being controlled by the same variable speed drive means independently of the variable speed drive means of the center track.

9. The game of claim 8 wherein the game is a roundabout game with said tracks on said platform defining closed endless paths.

10. A racing game, comprising:

a base structure having platform means with means defining a plurality of side-by-side tracks, a plurality of playing pieces movable along said tracks, said playing pieces being removably mounted on said tracks and including wing-type interference protrusions on at least one side thereof, said interference protrusions having a forwardly facing abutment surface and a complementary rearwardly facing abutment surface, said surfaces being inclined rearwardly and upwardly to effect a wedging action between playing pieces on adjacent tracks to permit a playing piece to be knocked off of the tracks on interference by a playing piece on an adjacent track.

* * * * *